United States Patent [19]

Horvay

[11] 4,227,383

[45] Oct. 14, 1980

[54] REFRIGERATOR INCLUDING THROUGH-THE-DOOR ICE SERVICE

[75] Inventor: Julius B. Horvay, Louisville, Ky.

[73] Assignee: General Electric Company, Louisville, Ky.

[21] Appl. No.: 35,954

[22] Filed: May 4, 1979

[51] Int. Cl.[3] ..... F25C 5/18

[52] U.S. Cl. ..... 62/344; 222/351

[58] Field of Search ..... 62/344, 377; 222/362, 222/350, 351, 347; 221/263; 251/353, 354

[56] References Cited

U.S. PATENT DOCUMENTS

| | | | |
|---|---|---|---|
| 1,035,515 | 1/1914 | Amsler | 222/362 X |
| 1,991,736 | 2/1935 | Epstein | 222/362 X |
| 2,212,405 | 8/1940 | Rose et al. | 62/345 |
| 2,697,918 | 12/1954 | Comstock | 62/106 |
| 2,775,270 | 12/1956 | McKillop, Jr. | 222/362 X |
| 3,231,150 | 1/1966 | Holm et al. | 239/350 X |
| 3,572,053 | 3/1971 | Jacobus et al. | 62/344 |
| 3,602,007 | 8/1971 | Drieci | 62/344 |
| 3,640,088 | 2/1972 | Jacobus et al. | 62/320 |
| 3,747,363 | 7/1973 | Grimm | 62/377 |

*Primary Examiner*—Albert J. Makay
*Assistant Examiner*—William E. Tapolcai, Jr.
*Attorney, Agent, or Firm*—Frederick P. Weidner

[57] ABSTRACT

A refrigerator, including an ice cube storage receptacle on the inner surface of the freezer door, a passage through the door communicating with the interior of the receptacle and a closure member pivotally mounted on the exterior surface of the freezer door for closing the passage. The closure member carries a delivery tube extending through the passage and in communication with the ice cube storage receptacle and delivers the ice pieces to the exterior of the freezer door when the closure member is open. There is provided an ice piece stop assembly for preventing the passage of ice pieces into the passage when the closure member is opened and includes at least one gate member movable from a first position obstructing the passage to a second position opening the passage, said gate member being biased to move to the first position when the closure member is opened and moved to the second position by the delivery tube exerting force on the gate member to open the passage when the closure member is closed.

8 Claims, 3 Drawing Figures

REFRIGERATOR INCLUDING THROUGH-THE-DOOR ICE SERVICE

BACKGROUND OF THE INVENTION

The present invention is directed to a household refrigerator including a freezer compartment containing an ice receptacle mounted on the interior surface of the freezer access door and manually-operable means for delivering ice pieces from the receptacle through the door.

U.S. Pat. Nos. 3,572,053—Jacobus et al and 3,640,088—Jacobus et al disclose household refrigerators including exterior ice services having an ice passage in a freezer door and combination receptacle and dispensing means for delivering batches of ice pieces from the receptacle to the passage. The dispensing means is motor operated and designed to deliver batches of ice pieces periodically to the passage during operation of the motor.

U.S. Pat. Nos. 2,212,405—Rose et al and 2,697,918—Comstock disclose exterior ice services in which ice pieces are dispatched directly from an ice maker through a cabinet wall or the cabinet door, the amount of ice available at any one time being limited by the storage capacity of the ice makers.

U.S. Pat. No. 3,602,007—Drieci discloses through-the-door ice service comprising a receptacle mounted on the interior surface of a small ice access door provided in the main freezer door so that the ice stored in the receptacle is available exteriorly by opening the pivoted ice access door without opening the main freezer door.

U.S. Pat. No. 3,747,363—Grimm discloses refrigerator including an ice cube storage receptacle on the inner surface of the freezer door, a passage through the door communicating with the interior of the receptacle and a trap door pivotally mounted on the exterior surface of the freezer door for closing the passage. The trap door carries a delivery tube extending through the passage and up into the storage receptacle for picking up ice pieces from the receptacle and delivering the ice pieces to the exterior of the freezer door when the trap door is opened. There is also disclosed stop means for limiting the passage of ice pieces through the delivery tube when the trap door is opened.

The present invention is directed specifically to an improved exterior ice service combining the advantages of an ice storage receptacle for storing a relatively large amount of ice pieces with a manually-operable ice dispensing means for dispensing small batches of ice, for example, batches of one to four ice pieces exteriorly of the refrigerator, without opening the main freezer door.

SUMMARY OF THE INVENTION

There is provided a refrigerator comprising a freezer compartment and a main freezer door for closing the access opening to the compartment and an ice storage receptacle supported on the inner surface of the freezer door. The freezer door includes a passage with an opening area communicating with the interior of the receptacle and a pivoted closure member mounted on the outer surface of the door for normally closing the passage. The closure member includes a tubular ice piece delivery member having an internal and an external end, the external end being carried on the inner surface of the closure member. The tubular member has a length sufficient to extend at least into the opening area of the passage when the closure member is in its closed position. The tubular member also includes an opening in the bottom wall portion thereof intermediate the ends of the member for dispensing ice pieces contained therein when the closure member is moved to its open position. There is also provided stop means in the opening area for preventing the passage of ice pieces into the passage when the closure member is in its open position. The stop means includes at least one gate member movable by biasing means to a first position obstructing the passage when the closure member is opened and movable by the tubular member exerting force on the gate member to a second position opening the passage when the closure member is closed.

BRIEF DESCRIPTION OF THE DRAWINGS

With reference to the accompanying drawings.

DESCRIPTION OF THE PREFERRED EMBODIMENT

With reference to the accompanying drawings, there is shown a household refrigerator including a freezer compartment 1 having an access opening at the front thereof closed by a main freezer door 2. An ice storage receptacle 3 is suitably supported on the inner surface of the freezer door 2, the receptacle 3 being adapted to store a substantial quantity of ice pieces. The receptacle 3 may be manually filled with ice pieces, although preferably ice pieces are supplied to the storage receptacle 3 and the receptacle kept filled with ice pieces by a suitable ice maker 4 as described in the aforementioned Drieci U.S. Pat. No. 3,602,007 or in Swerbinsky U.S. Pat. No. 3,621,668, both of which patents are assigned to the same assignee as the present invention.

Figure 1:
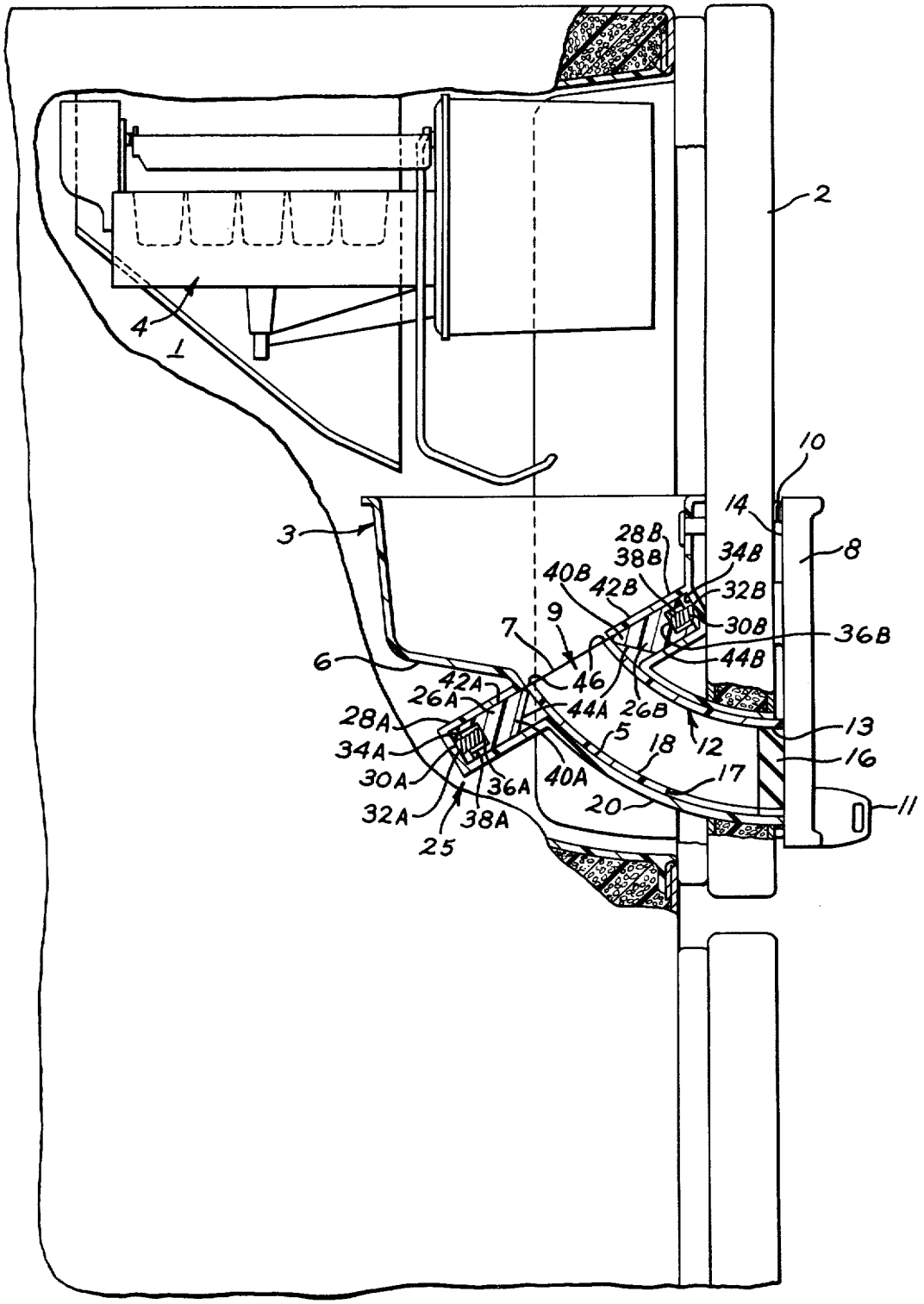
FIG. 1 is a side elevational view, partly in section, of the freezer portion of a refrigerator including the ice delivery means of the present invention in its non-dispensing position.
Figure 2:
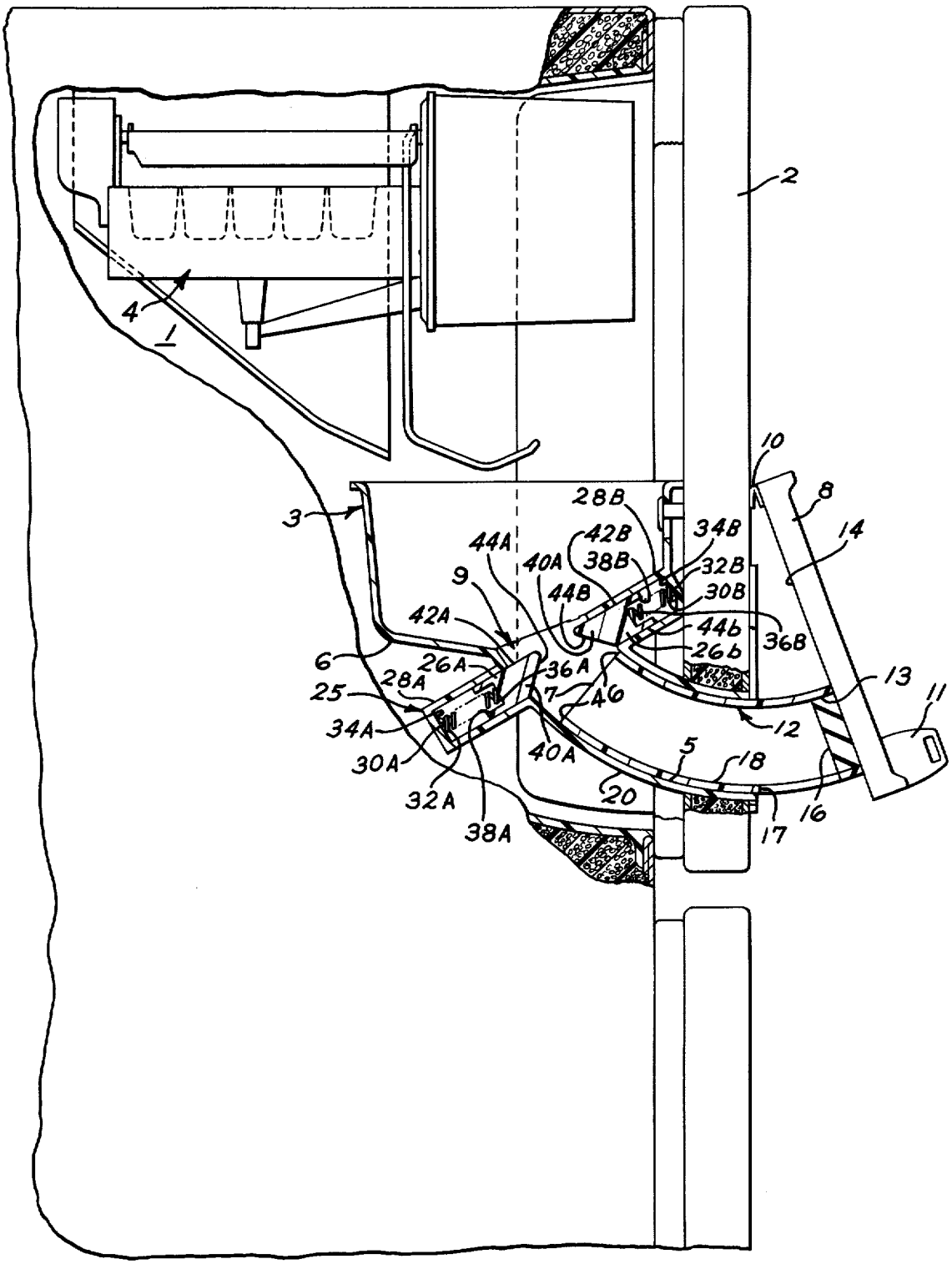
FIG. 2 is a sectional view of a portion of the door structure in FIG. 1 showing the ice delivery means in its dispensing position.

The door 2 includes a relatively small passage 5 extending through the door below the bottom wall 6 of the receptacle and communicating with the interior of the receptacle at an opening area 9 by means of an opening 7 in the bottom wall 6 of the receptacle. A closure member in the form of a small trap door 8 mounted on the outer surface of door 2 normally closes the passage 5 and in the illustrated embodiment of the invention this trap door 8 is pivotally supported or hinged along its upper edge, as indicated at 10, for tilting movement about a horizontal hinge axis from a normally closed position, as illustrated in FIG. 1 of the drawing, to an open position as illustrated in FIG. 2 of the drawing. A handle 11 is provided for convenient opening of the door 8.

The ice piece dispensing or delivery means comprises a tubular member generally indicated by the numeral 12 suitably supported at its outer or external end 13 on the inner or rear surface 14 of the closure member 8 and extending through the passage 5 and at least into the opening area 9. This tubular member, which may be of any cross-sectional shape but is preferably of a rectangular cross section, is of an arcuate configuration so that as the closure member 8 is pivotally moved between its closed position and its open position about its hinge axis 10 the tubular member 12 will clear or move freely through the passage 5. The outer or external end 13 of the tubular member 12, that is, the end mounted on the rear surface 14 of the closure member 8, might be provided with a mass of insulating material 16 further heat insulating the interior of the tubular member from the ambient air.

The bottom wall portion 18 of the tubular member 12 is provided with an opening 17 adjacent its external end 13 for dispensing ice pieces contained in the tubular member when the closure member is in its open position illustrated in FIG. 2 of the drawing.

The tubular member 12 is, of course, of a large enough cross-sectional size so that ice pieces stored in the receptacle 3 or contained therein above the level of the open inner end 15 of the tubular member 12 will freely pass into the tubular member and completely fill it. Preferably, the tubular member is of a length such that it will, on the average, contain a plurality of ice pieces, as for example, three or four ice pieces.

When the closure member 8 is pivoted to its open position, the outlet opening 17, normally closed by the forward bottom wall 20 of the passage 5, will be exposed exteriorly so that the ice pieces in the tubular member 12 will flow freely through the opening 17 and into a container (not shown) supported or held below the passage 5.

Preferably, in order to limit the number of ice pieces which will be dispensed during each opening of the closure member, there is provided a stop means or assembly 25 adapted to stop ice pieces from flowing into the tubular member 12 during the opening of the closure member 8 and to limit the number of ice pieces dispensed through the opening 17. In the illustrated embodiment of the invention, this stop means 25 comprises one or more gate members, such as 26A and 26B, which are movably retained in hollow housing members 28A and 28B respectively. The gate members 26A and 26B are movable from a first position obstructing the passage 5 as shown in FIG. 2 to a second position opening the passage 5 as shown in FIG. 1. The gate members 26A and 26B, and their respective housing members 28A and 28B, are positioned opposing each other and the gate members are biased to the first position by biasing means such as coil springs 30A and 30B respectively. One end of 32A of coil spring 30A abuts the rear wall 34A of the hollow housing member 28A, while the opposite end 36A of coil spring 30A abuts or is seated in a cavity 38A in the gate member 26A. Likewise, the one end 32B of coil spring 30B abuts hollow housing member 28B at the rear wall 34B, while the opposite end 36B of coil spring 30A is seated in a cavity 38B of the gate member 26B. The hollow housing members 28A and 28B and their movable retained gate members 26A and 26B are arranged and positioned so that when the coil springs 30A and 30B bias the gate members 26A and 26B toward each other, they are moved to the first position, obstructing the passage 5. The forward ends 40A and 40B of the gate members 26A and 26B, respectively, are shown in FIG. 2 as spaced apart in the first position. It will be understood that the spaced distance is insufficient to allow ice pieces to pass from the receptacle 3 into the passage 5. It is also possible to have the forward ends 40A and 40B abut each other if so desired. The upper surfaces 42A and 42B of the respective gate members 26A and 26B, that is, those surfaces nearest ice receptacle 3 are relatively flat or planer with respect to each other. The lower surfaces 44A and 44B of the gate members 26A and 26B respectively are cam surfaces and they diverge from each other in a direction away from the forward ends 40A and 40B of the gate members 26A and 26B as shown in FIG. 2. That is, the gate members are wedge-shaped and, therefore, provide cam surfaces on each of the gate members 26A and 26B. The stop means or assembly 25 is located in the opening area 9 which is a general area in the passage 5 below the opening 7 of the ice receptacle 3.

The tubular member 12 carries or is formed with a force-applying portion 46. In the preferred embodiment of the invention, the tubular member is of a rectangular cross section and in this case, two of the walls of the rectangular-shaped tubular member are formed with the force-applying portion 46.

In operation, when the door or closure member 8 is in its second or open position, as shown in FIG. 2, the tubular member 12 is moved outwardly along with the door 8 so that the opening 17 in the tubular member is no longer blocked by the bottom wall 20 of the passage 20 and the length of the tubular member 12 is such that in the door 8 open position force-applying elements 46 have been withdrawn from the opening area 9. With the tubular member 12 in this position, gate members 26A and 26B being biased toward each other, are moved toward each other, and obstruct the passage 5 and prevent any ice pieces from flowing from the ice receptacle 3 into the passage 5 and tubular member 12. Any ice pieces in the tubular member 12 will pass through the opening 17.

Upon closing the closure member 8, tubular member 12 is moved inwardly and upwardly with force-applying portions 46 coming into contact with the cam surfaces 44A and 44B of the gate members 26A and 26B respectively. Further urging of the tubular member 12 inwardly and upwardly by continuing to push the closure member 8 closed causes the biasing force of the springs 30A and 30B to be overcome and the gate members 26A and 26B are moved to their second position opening the passage 5 and allowing the ice pieces in the ice receptacle to once again flow into the tubular member 12 until it is full. This position is shown in FIG. 1. It will be realized that after the ice pieces have flowed into the tubular member 12, that they may again be dispensed upon the user opening the closure member 8 and allowing them to pass through the opening 17.

Figure 3:
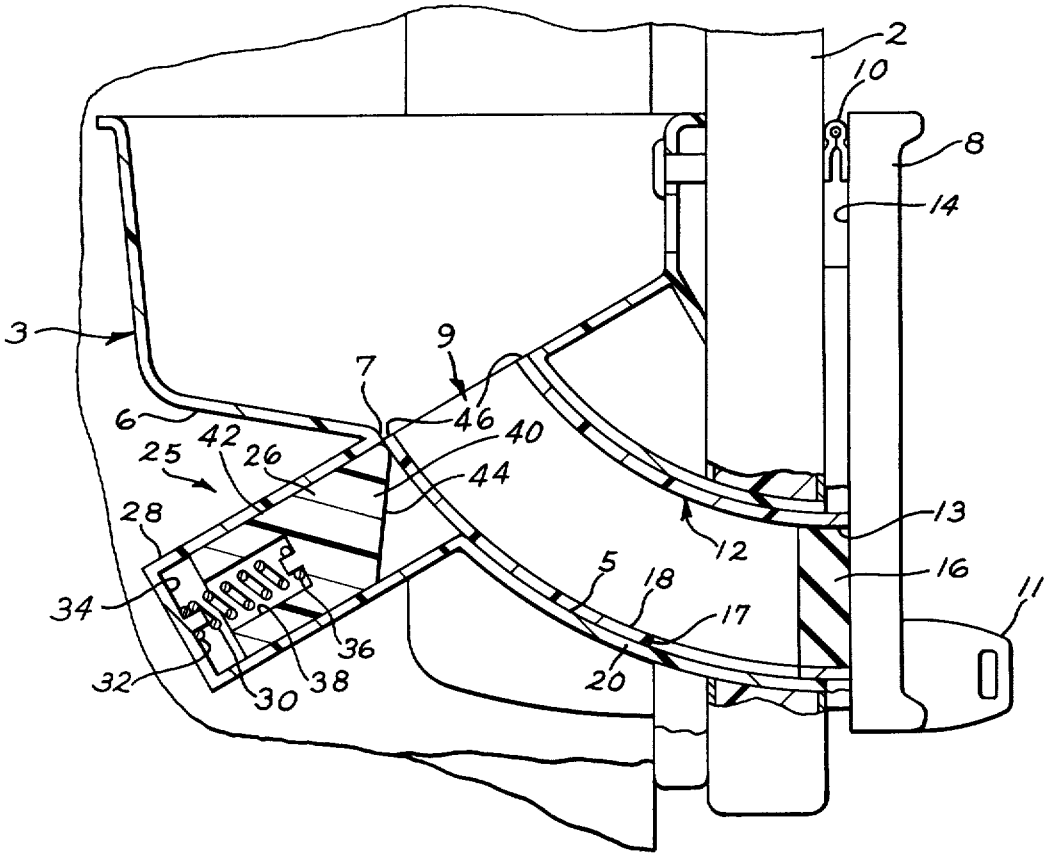
FIG. 3 is a view of the stop means of the present invention utilizing a single gate member to prevent the number of ice pieces delivered during each operation of the delivery means.

While FIGS. 1 and 2 show the preferred arrangement or embodiment of the present invention wherein two opposing gate members 26A and 26B are utilized, it is possible that only a single gate member may be used and, accordingly, FIG. 3 of the drawings shows such a structural arrangement wherein the elements are numbered corresponding to a single gate assembly. In the arrangement shown in FIG. 3, the gate member 26 carries the cam surface 44. The gate member 26 moves back into a rearward position, as shown in FIG. 3, when the tubular member 12 is moved inwardly and upwardly, as by closing closure member 8, and the biasing force of spring 30 is overcome. This is the second position of the gate member 26 and the passage 5 is open. Upon opening the closure member 8, the tubular member 12 is moved outwardly and with the force-applying portion 46 withdrawn from the opening area 9, the gate member 26 is moved by the biasing force of the spring 30 to the first position obstructing the passage 5. That is, the gate member 26 extends across the passage 5 a distance sufficient to prevent the ice pieces from passing from the receptacle 3 into the passage 5.

From the above description, it will be seen that there has been provided a simple, low-cost manually-operable, ice dispensing means adapted to dispense small batches of ice, as for example, a batch sufficient to fill a normal drinking glass, from a receptacle adapted to store a relatively large amount of ice pieces. The structural arrangement of the elements provides for a clear or unobstructed passage 5 for a smooth return of the tubular member 12 when the closure member 8 is closed.

While there has been shown and described a specific embodiment of the invention, it will be understood that it is not limited thereto and that it is intended by the appended claims to cover all such modifications as fall within the true spirit and scope of the invention.

What is claimed is:

1. In a refrigerator comprising a freezer compartment and a door for closing the access opening to said compartment;

an ice storage receptacle supported on the inner surface of said door;

said door having a passage with an opening area communicating with the interior of the receptacle;

a closure member mounted on the outer surface of said door for opening and closing said passage, said member being pivotally mounted on said door above said passage;

a tubular member extending within the passage and having an internal and an external end, the external end being carried on the inner surface of said closure member, said tubular member having a shape adapted to clear the walls of said passage during pivotal movement of said closure member and a length sufficient to extend at least into the opening area when the closure member is closed, said tubular member having an opening in the bottom wall portion thereof intermediate the ends of said member for dispensing ice pieces contained in said tubular member when said closure is in its open position; and stop means located in the opening area for preventing the passage of ice pieces into the passage when the closure member is opened comprising at least one wedge-shaped gate member having a cam surface and movable by biasing means to a first position obstructing the passage when the closure member is opened and movable by the tubular member exerting force on the cam surface of the gate member to a second position opening the passage when the closure member is closed.

2. In the refrigerator of claim 1 wherein the stop means includes two gate members biased toward each other.

3. In the refrigerator of claim 1 wherein the biasing means is a compression spring.

4. In the refrigerator of claim 1 wherein the tubular member has an arcuate shape as the internal end thereof extends upwardly toward the ice storage receptacle.

5. In the refrigerator of claim 1 wherein the tubular member is of rectangular cross-section.

6. In a refrigerator comprising a freezer compartment and a door for closing the access opening to said compartment;

an ice storage receptacle supported on the inner surface of said door;

said door having a passage with an opening area communicating with the interior of the receptacle;

a closure member mounted on the outer surface of said door for opening and closing said passage, said member being pivotally mounted on said door above said passage;

a tubular member having an external end carried on the inner surface of said closure member, said tubular member extending within said passage and having an internal end opening upwardly toward said receptacle, said tubular member having an arcuate shape for clearing the walls of said passage during pivotal movement of said closure member and a length sufficient to extend at least into the opening area when the closure member is closed, said tubular member having a discharge opening in the bottom wall portion thereof intermediate the ends of said member for dispensing ice pieces contained in said tubular member when said closure member is in its open position and said discharge opening being normally closed by the walls of the passage when the closure member is in its closed position;

stop means located in the opening area passage for preventing the passage of ice pieces into the passage when the closure member is opened comprising two gate members biased toward each other and each having a cam surface, said gate members movable to a first position by biasing means obstructing the passage when the closure member is opened and movable to a second position opening the passage by the tubular member exerting force on the cam surfaces when the closure member is closed.

7. The refrigerator of claim 6 wherein the tubular member is of a rectangular cross-section.

8. In the refrigerator of claim 6 wherein the internal end of the tubular member carries a force-applying portion to contact the cam surface of each gate member to move the gate members to their second position when the closure member is closed.

* * * * *